US010465867B2

(12) United States Patent
Gantenbrink

(10) Patent No.: US 10,465,867 B2
(45) Date of Patent: Nov. 5, 2019

(54) LINEAR LIGHT AND METHOD FOR MOUNTING OF SAID LIGHT

(71) Applicant: BEGA Gantenbrink-Leuchten KG, Menden (DE)

(72) Inventor: Heinrich J. Gantenbrink, Menden (DE)

(73) Assignee: BEGA GANTENBRINK-LEUCHTEN KG, Menden (DE)

( * ) Notice: Subject to any disclaimer, the term of this patent is extended or adjusted under 35 U.S.C. 154(b) by 0 days.

(21) Appl. No.: 15/881,561

(22) Filed: Jan. 26, 2018

(65) Prior Publication Data

US 2018/0231196 A1 Aug. 16, 2018

(30) Foreign Application Priority Data

Feb. 10, 2017 (EP) ..... 17155692

(51) Int. Cl.

| | |
|---|---|
| ***F21S 4/00*** | (2016.01) |
| ***F21V 23/02*** | (2006.01) |
| ***F21S 4/28*** | (2016.01) |
| ***F21S 8/00*** | (2006.01) |
| ***F21S 8/06*** | (2006.01) |
| ***F21V 21/005*** | (2006.01) |
| ***F21V 21/02*** | (2006.01) |
| ***F21V 3/06*** | (2018.01) |

(Continued)

(52) U.S. Cl.

CPC ..... *F21S 4/28* (2016.01); *F21S 8/038* (2013.01); *F21S 8/066* (2013.01); *F21V 3/061* (2018.02); *F21V 7/00* (2013.01); *F21V 17/101* (2013.01); *F21V 17/16* (2013.01); *F21V 21/005* (2013.01); *F21V 21/025* (2013.01); *F21V 23/06* (2013.01); *F21S 8/026* (2013.01); *F21W 2131/10* (2013.01); *F21Y 2103/00* (2013.01); *F21Y 2115/10* (2016.08)

(58) Field of Classification Search

CPC ..... F21S 4/00; F21S 4/20; F21S 4/28; F21S 8/00; F21S 8/02; F21S 8/026; F21S 8/038; F21S 8/06; F21S 8/066; F21V 3/061; F21V 7/00; F21V 17/101; F21V 17/16; F21V 21/005; F21V 21/025; F21V 23/06; F21W 2131/10; F21Y 2103/00; F21Y 2115/10

USPC ..... 362/217.01–217.17, 218–225, 249.02, 362/311.02, 800

See application file for complete search history.

(56) References Cited

U.S. PATENT DOCUMENTS

| | | | | |
|---|---|---|---|---|
| 8,007,128 | B2 * | 8/2011 | Wu | F21S 8/086 362/249.02 |
| 9,097,411 | B2 * | 8/2015 | Guilmette | F21V 21/00 |
| 9,857,065 | B2 * | 1/2018 | Park | F21V 21/049 |

FOREIGN PATENT DOCUMENTS

| | | |
|---|---|---|
| DE | 20 2013 102670 U1 | 9/2014 |
| EP | 2 650 607 A1 | 10/2013 |
| EP | 3 067 617 A1 | 9/2016 |

* cited by examiner

*Primary Examiner* — Jason M Han
(74) *Attorney, Agent, or Firm* — Baker & Hostetler LLP

(57) ABSTRACT

A linear light is provided with an axially extending housing in which an optical element and an electrical element are integrated. In this context, the optical element is formed as a profile that corresponds approximately to the length of the housing, and the electrical element is also formed as a profile, wherein the profiles can be inserted axially into the housing via a front side and are braced against one another transversially to the axial direction in the mounted state. The invention further relates to a method for mounting this linear light.

15 Claims, 5 Drawing Sheets

(51) Int. Cl.

| | |
|---|---|
| ***F21V 7/00*** | (2006.01) |
| ***F21V 17/10*** | (2006.01) |
| ***F21V 17/16*** | (2006.01) |
| ***F21V 23/06*** | (2006.01) |
| *F21Y 103/00* | (2016.01) |
| *F21Y 115/10* | (2016.01) |
| *F21S 8/02* | (2006.01) |
| *F21W 131/10* | (2006.01) |

LINEAR LIGHT AND METHOD FOR MOUNTING OF SAID LIGHT

CROSS-REFERENCE TO RELATED APPLICATION

This application claims priority to foreign European patent application No. EP 17 155 692.1, filed on Feb. 10, 2017, the disclosure of which is incorporated by reference in its entirety.

FIELD OF THE INVENTION

The present invention relates to a linear light with an axially extending housing in which an optical element and an electrical element are integrated.

The use of lights with a longitudinal form, which are usually referred to as linear lights, is known for the illumination of indoor and outdoor areas. In this context, the lights can be installed directly on walls or ceilings or also be formed as suspended lights.

BACKGROUND

Linear lights usually comprise a straight or bent housing that extends longitudinally and in which at least illuminants are integrated. Likewise, also the electrical connection can be arranged on the inside of the housing, but can also be connected to the illuminant from the outside. Here, a fluorescent tube or a series of light diodes and/or a plurality of illuminants and their operating elements can be used as an illuminant.

In particular when light diodes are used it is necessary to provide an additional optical system that disperses the created light in order to achieve an even illumination. Here, also the radiation characteristic can be controlled systematically by means of the optical system.

During mounting of a respective linear light, a housing section is usually at first screwed to the wall or ceiling and subsequently a carrier profile, on which the illuminants are installed, is fastened on said housing section. Finally, the optical system is installed on the housing section or on the carrier profile.

In particular in cases where mounting occurs in an outdoor area and where the impermeability of the housing is of considerable importance, appropriate mounting is time-consuming and comes with many loopholes with regard to ensuring impermeability. Likewise, it is necessary to remove the light completely in case of failure of said light in order to check and/or to replace the individual elements.

A modular LED light, comprising a housing that absorbs a light module and a control with a cladding, is known from the EP 2 650 607 A1. Here, the housing has a two-part form with an upper chamber in which the cables are arranged and a lower chamber in which the control and the light module are integrated. The individual elements are displaced in relation to one another in a longitudinal direction in order to be arranged within the housing in this way, wherein locking elements are provided in the area of the illuminant in order to fasten the housing and a section of the control transversally to the axial direction.

SUMMARY OF THE INVENTION

The object of the present invention is to provide a linear light of the known category that is characterized by a clearly simplified mounting as well as by good impermeability of the housing.

This problem is solved by a linear light with an axially extending housing in which an optical element and an electrical element are integrated, wherein the optical element is formed as a profile that corresponds approximately to the length of the housing and the electrical element is also formed as a profile, wherein the profiles are can be inserted axially into the housing via a front side and are braced against one another transversally to the axial direction in the mounted state; the problem is further solved in a way that the housing is closed on all sides and has an opening, which is smaller than the sum of the cross-section area that is formed by the encasings of both profiles, on an axial side.

The linear light according to the invention can be mounted particularly easily because the individual elements can be inserted into the housing particularly easily and because the housing with the elements already inserted can be fastened on the wall or ceiling in one single step. Here, the design of the elements as a profile facilitates the insertion of the elements and at the same time the arrangement of the elements on top of one another. In addition, the elements can be replaced easily so that the costs for maintenance and repair can be reduced significantly. Due to the additional provision of a bracing of the profiles against one another, it is ensured that the components of the light are mounted in a rattle-free way and at the same time installed unambiguously in their final position.

In particular in cases where the linear light is used in an outdoor area, in which an increased impermeability against permeation of water and foreign matter can be ensured, this embodiment offers the possibility to form the inlet opening as small as possible so that the area to be sealed can be kept small in proportion to the overall light. This enables at the same time a very compact structure of the light.

Another preferred embodiment can provide that the axial side that bears the opening is closed with an intake cover, wherein the opening is arranged on an area of the intake cover that faces away from the light-emitting opening. Also this embodiment, in turn, serves the compact structure of the light. The provision of an intake cover allows for a systematic design of the intake opening and in addition provides a fastening element for the optical profile. Here, the optical profile is held by the closing elements, i.e. the intake cover as well as an end cap, on both axial sides and hence fastened. As the intake opening is formed smaller than the sum of the cross-section area that is formed by the encasings of both profiles, the profiles have to be inserted in the housing one-by-one. The optical element that is inserted first "falls" ["fällt"] down after the insertion in order to make room for the second one, i.e. the electrical profile. After this positioning, the optical profile is located directly on a glass element that seals the light-emitting opening and that is fastened in the area of the intake cover at least in sections by the area under the intake opening.

According to another preferred embodiment, the top side of the optical profile can be formed with slide sections that interact with the electrical profile. After positioning of the optical element, the surface of said optical element is still arranged visibly in the area of the intake opening because the optical profile has only lowered itself in sections down into the housing. Through the formation of slide sections it is possible to simply install the electrical profile on the already inserted profile rail and to slide it in on said rail. In this context, the slide sections do no have to extend over the entire profile but can be provided in sections only.

Further, it has proven to be effective to have spring elements, which brace the profiles against one another in the axial direction, installed between the optical profile and the electrical profile. Here, the spring element can be arranged on the electrical profile, i.e. on the side of the electrical profile that is located opposite to the optical profile. The use of spring elements is a particularly simple but effective embodiment to achieve the bracing of the two profiles against one another. Through the positioning of the spring element on the bottom side of the electric profile, the spring element is simply inserted together with the electrical profile and supports itself on a support rail of the optical profile during inserting. In this context, multiple spring elements are preferably provided along the electrical profile. Through inserting into the housing, the spring elements come in contact with the optical profile and are compressed by their wedge- or arc-shaped cross-section and therefore create a clamping force between the two profiles.

Another preferred embodiment can provide for the arrangement of rigid clamping elements between the optical profile and the electrical profile and for the elastic design of the optical profile and the electrical profile in the area of the rigid clamping elements. This embodiment provides a variant of the aforementioned variant, wherein rigid wedges are used instead of spring elements and wherein the required elasticity is provided by the profiles.

According to another embodiment, guiding grooves, which interact with the electrical profile and the optical profile, can be arranged on the vertical walls of the housing. By means of appropriate guiding grooves, which interact with the elements that mesh with the guiding grooves, the insertion and in this case in particular tilting of the profiles can be prevented even better. Here, it is required to design the guiding groove in such a way that lowering ["Absenken"] of the optical profile is ensured. Likewise, it is also possible to form only the electrical profile with appropriate elements that mesh with the guiding groove.

Sealing elements can preferably be formed in the area of the intake opening. As the intake opening is formed as the axial side, simple, small sealings are sufficient here to ensure sufficient impermeability also in the outdoor area.

Consequently, the linear light according to the invention can in particular also be used in outdoor areas without additional constructive measures being required.

Further, the use of LED lights has proven to be effective in order to achieve a light that is formed as compactly as possible.

According to a further preferred embodiment, the housing can be made of aluminum and have a rectangular cross-section.

Further, it has proven to be preferred when the axial side of the housing, which is located opposite to the intake opening, is equipped with an end cap that is welded on said axial side. Therefore, an even better closing of the housing is ensured.

Moreover, the present invention provides a method for mounting a linear light in an axially extending housing, comprising the following steps: inserting of the optical elements in form of a profile, which approximately corresponds to the length of the housing, through an intake opening that is formed in the area of a front side, wherein the intake opening is disposed in the upper area of the front side, fastening of the optical profile on a light-emitting opening between the areas of the front side that are adjacent to the light-emitting opening, inserting of an electrical element in form of a profile, bracing of the optical profile and the electrical profile against one another in a transversal direction to the axial direction.

In this process, the optical element is positioned at least in sections below the intake opening between the axial sides on the light-emitting opening after inserting into the housing. Consequently, the optical element lowers itself independently and is therefore fastened in the housing without any additional measures.

Through the method according to the invention it is possible to mount a linear light in a fast and rattle-free way. Likewise, it is possible to dismantle the system in a simple way in order to perform maintenance or repair works.

The light according to the invention and/or the light that is mounted according to the invention has a very compact structure, wherein the individual profiles are set unambiguously in their final position. In this context, the inside of the housing is fully utilized, and the individual components are fasted in a way that they are rattle-free and secure in relation to one another. As only very small sealings are required, the light is particularly suited for outdoor areas.

BRIEF DESCRIPTION OF THE DRAWINGS

A preferred embodiment of the present invention will be described in greater detail in the following and with reference to the enclosed drawings. The Figures show.

DETAILED DESCRIPTION

The linear lights displayed in the embodiments are identical to one another in essential features. Here, all identical features are marked with identical reference signs and the identical features of both embodiments are not explained separately.

Figure 1:
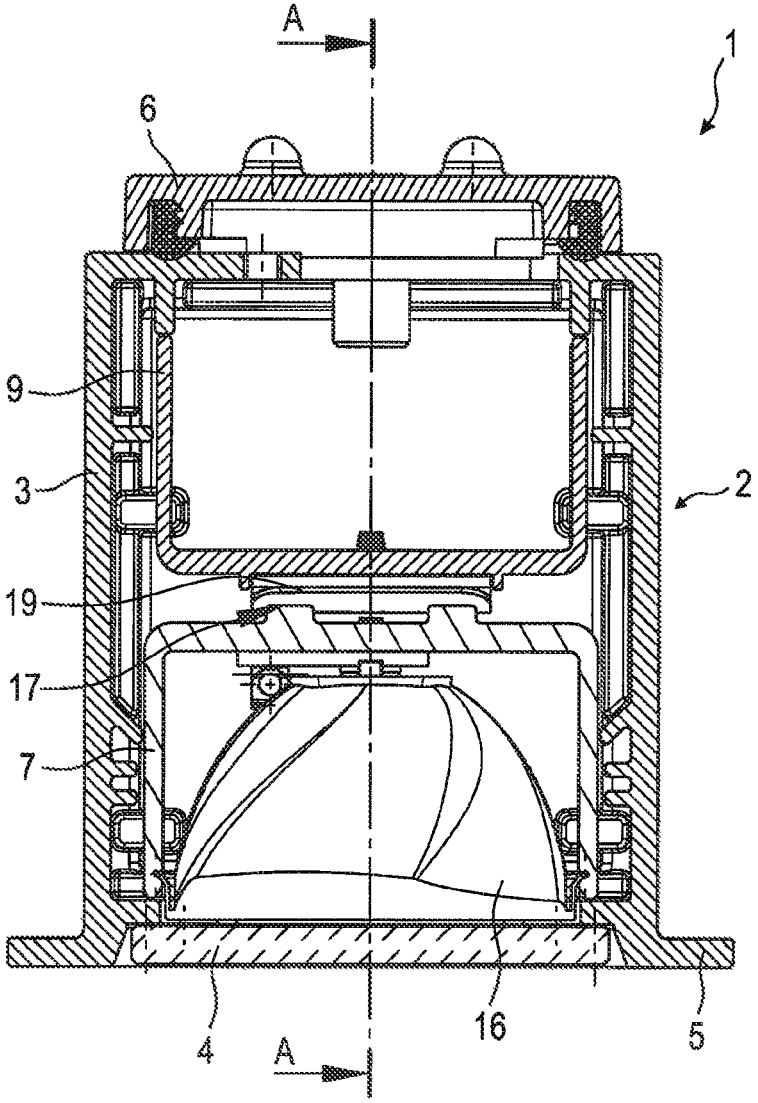
FIG. 1 a cross-section through a linear light according to the invention, wherein said light is a built-in ceiling light.
Figure 3:
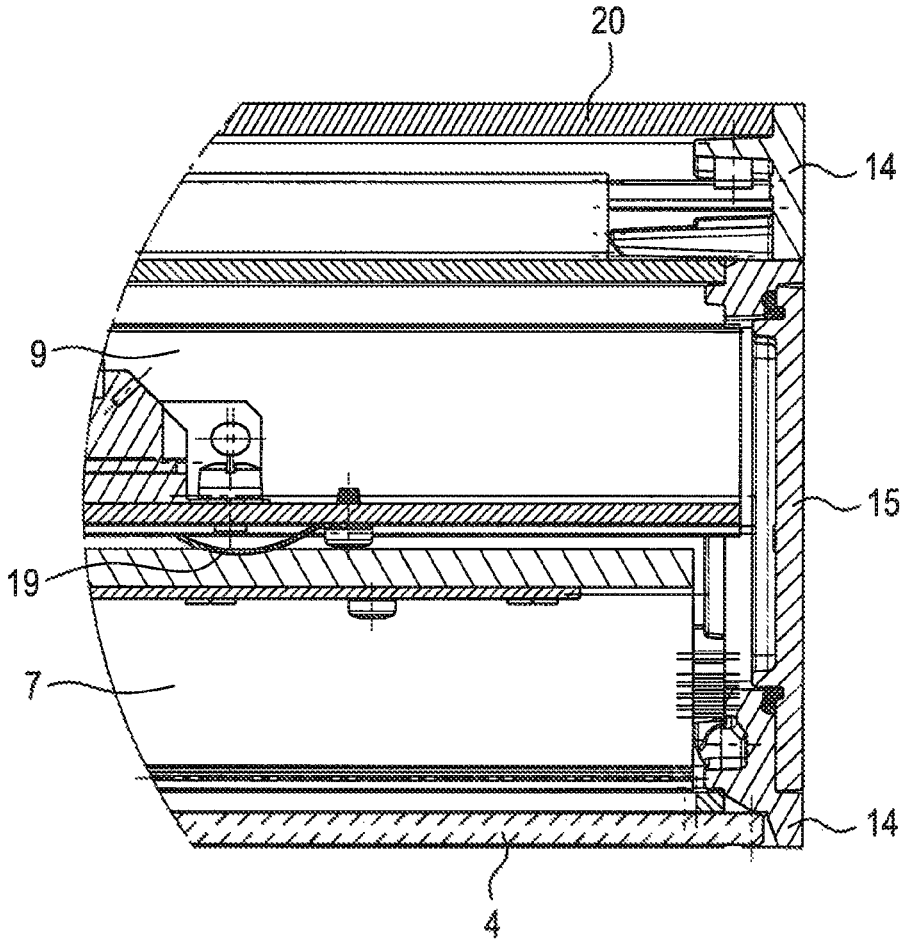
FIG. 3 a section through the built-in ceiling lamp displayed in FIG. 1 along the line A-A.

FIG. 1 and FIG. 3 show an embodiment of a linear light 1 according to the invention in the cross-section. The linear light 1 is thereby transversal to its longitudinal direction, i.e. sectioned in parallel to one of its front sides.

The linear light 1 comprises an outer housing 2 that is essentially formed in a rectangular way. Here, the outer housing 2 is formed by a U-shaped profile 3 as well as a glass plate 4 that closes the open side. In this context, the profile can be made of aluminum or another suitable material.

The side of the profile that is closed by the glass plate 4 corresponds to the long side of the profile and forms the light-emitting opening. Here, the glass panel can be glued into the opening. As displayed in FIG. 1, appropriate inputs are formed in the area of the profile 3 for this purpose. Adjacent to the glass plate, the profile 3 is formed with outward-extending holding elements 5 that extend longitudinally over the profile and that are used for fastening the light in the input, i.e. on a ceiling opening. The further part of the housing 3 is hereby integrated inside the ceiling opening so that only the holding elements 5 and the glass plate 4 are visible in the area of the ceiling.

Further and in case of the built-in light, an aperture, which can be closed with a lid 6, is formed at least in sections on the top side of the profile 3. The aperture as well as the lid enable an electrical connection of the light inside the mounting opening.

As illustrated in FIG. 3, the outer housing 2 is closed on both front sides on one hand by an end cap 10 and on the other hand by an intake lid 11. The end cap 10 extends over the whole front side of the outer housing 2 and can be formed in a way that it encroaches in sections under the top side of the profile 3 and on the inside of the glass panel 4 in order to achieve a particularly tight closure. Here, the end cap 10 is welded firmly with the housing so that it cannot be removed anymore. According to another embodiment, the end cap 10, however, can also be formed in a removable way so that it can be replaced at any time. In a lower area, i.e. adjacent to the glass panel, the end cap 10 also has a holding element 12 that is formed in a similar way as the holding element 5 and that extends away from the housing in an outward direction. In the mounted state, this holding element fits closely to the ceiling around the opening and can for example be provided with a screw 13 for fastening the light in the mounting opening.

The other front side is closed by the intake lid 11. Here, the intake lid 11 has a two-part form, comprising an outer frame 14 as well as a lid 15. The lid 15 is hereby used to close an opening in the area of the front side, i.e. of the opening that is enclosed by the outer frame 14 that enables the inner parts ["Innenleben"] to be inserted in the housing. The opening hereby has a size that extends over the whole horizontal width of the front side, but only over a predetermined area of the vertical height. In particular, the opening is essentially adjacent to the top side of the profile 3, i.e. the side that is located opposite to the glass plate 4, or is arranged in close proximity to said top side. Adjacent to the glass plate 4, the front side is closed by the outer frame 14 that is formed with a greater width in this section and wherein this section of the outer frame, as also described in relation to the end cap 10, is formed with a holding element 12 into which a screw 13 or another fastening device can be inserted.

The lid 15 itself can be formed in a way that it engages in the opening but essentially extends over the whole front area, i.e. partially overlapping the outer frame 14. As a consequence, essentially only the lid, which is surrounded by a narrow area of the outer frame 14, is visible. In particular in cases where the linear light is used as a wall or ceiling light, a harmonious overall appearance is achieved this way.

A seal, for example a sealing ring, is preferably arranged between the outer frame 14 and the lid 15 so that the opening can be sealed completely. The lid can in this context have any possible form, but forming the lid as a hinged lid has proven to be particularly effective. The lid is hereby provided in a removable way so that it can be replaced by another lid at any time. For example if the connection of the lights should be ensured by the lid 15, an appropriate connector lid instead of the hinged lid can be used by the mounting technician in this case.

As illustrated in the Figures, two profile rails 7, 9, which are arranged on top of one another, are arranged inside the outer housing 2. This applies on one hand to the optical profile 7 as well as to the electrical profile 9.

The optical profile can comprise the LED illuminants as well as reflector elements 16 that ensure an even radiation of the light emitted by the LED. Here, a plurality of individual reflectors are usually arranged successively over the axial length but the reflector can also be formed as an isolated reflector area that extends over the entire length.

Both the LED illuminants as well as the reflector elements are disposed inside the U-shaped profile rail 7, wherein the rail can be formed in a way as to be open towards the bottom, i.e. in the direction of the glass plate 4.

In the installed state displayed in FIG. 1, the reflector 16 essentially lies directly on the glass plate 4 and is held in this position on one hand by the outer profile 3 and on the other hand by the inside of the elements that delimit the front areas. Here, the distance between the inner sides of the end cap 10 as well as of the intake lid 11 is dimensioned in a way that it essentially corresponds to the dimension of the optical profile 9. This way, the optical profile 9 can be held firmly within the housing 3, the end cap 10 and the intake lid 11 and is consequently secured against shifting.

In addition, an undercut, into which the optical profile encroaches and/or snaps during mounting in order to achieve an even better fixation of the optical profile inside the housing, can be formed in the area of the inner side of the intake lid 11 in the area of the outer frame 14 and adjacent to the glass plate 4. In this context, it would also be possible to provide snap-in protrusions or undercuts that interact with the optical profile 7 to be inserted.

Figure 4:
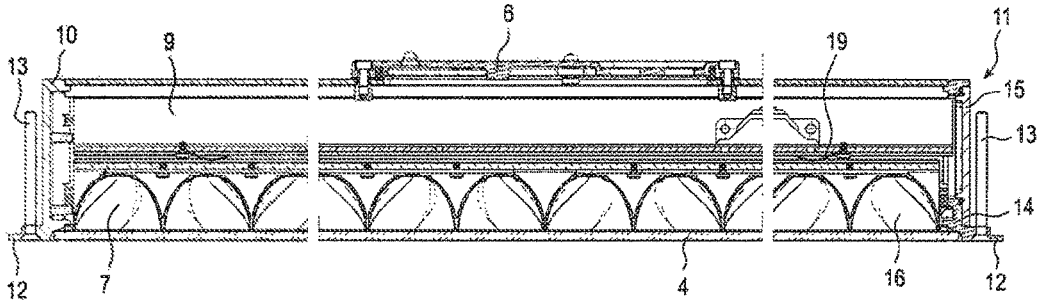
FIG. 4 a section through the ceiling and/or wall light displayed in FIG. 2 along the line B-B, and FIG. 5 a section through the ceiling and/or wall light displayed in FIG. 2 along the line C-C.
Figure 5:
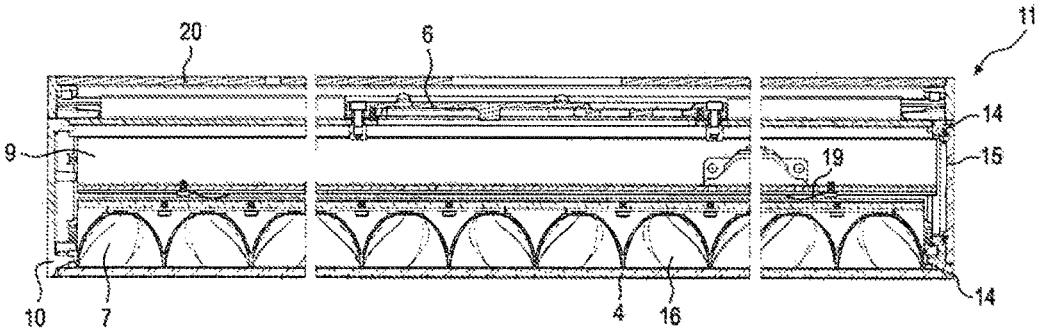

It becomes clear from FIGS. 3 and 4 that the lower area of the optical profile 9, i.e. approximately the halves of the reflectors 16, are disposed below the opening in the intake lid 11. Consequently and in order to take the optical element back out of the housing 1, it would be necessary to indicate said optical element at first until the top side is aligned essentially with the upper edge of the opening.

The top side of the optical profile 7, i.e. the side of the profile 7 that faces away from the glass plate 4, is formed with a sliding surface 17. This sliding surface 17 provides an improved inserting element for the electrical profile 9 through which said profile can simply be pushed into the desired position. A sliding surface can for example be provided through an elevation.

In contrast to the optical profile 7, the electrical profile 9 is formed with a U-shaped profile that is open towards the top and in which the electrical system is integrated. Consequently, the two base elements of the U-shaped profiles 7 and 9 are located on top of one another in the installed state.

The surface of the electrical profile 9 that faces the optical profile 7 is formed with an element that is adapted to the sliding surface 17 in the area of the sliding surface 7. If the sliding surface 7 is formed in form of an elevation, an appropriate recess that absorbs the elevation in that case can be provided in the area of the electrical profile. Through the interaction between the sliding surface 17 and an appropriate surface of the electrical profile 9, also a fixation of the two profiles on top of one another, by means of which a smooth insertion of the electrical profile 9 into the housing is enabled without there being any tilting risk, is achieved at the same time.

Further, spring elements 19 are disposed in the area of the recess 18 of the electric profile 9 that apply a clamping force onto the two profiles in the compressed state, i.e. when they are located between the two profiles, so that said profiles are braced against one another in a transversal direction to the axial direction.

The profiles, in particular the electrical profile 9, can in addition be screwed together with the outer profile 3 in order to fasten said outer profile further inside the outer housing.

Figure 2:
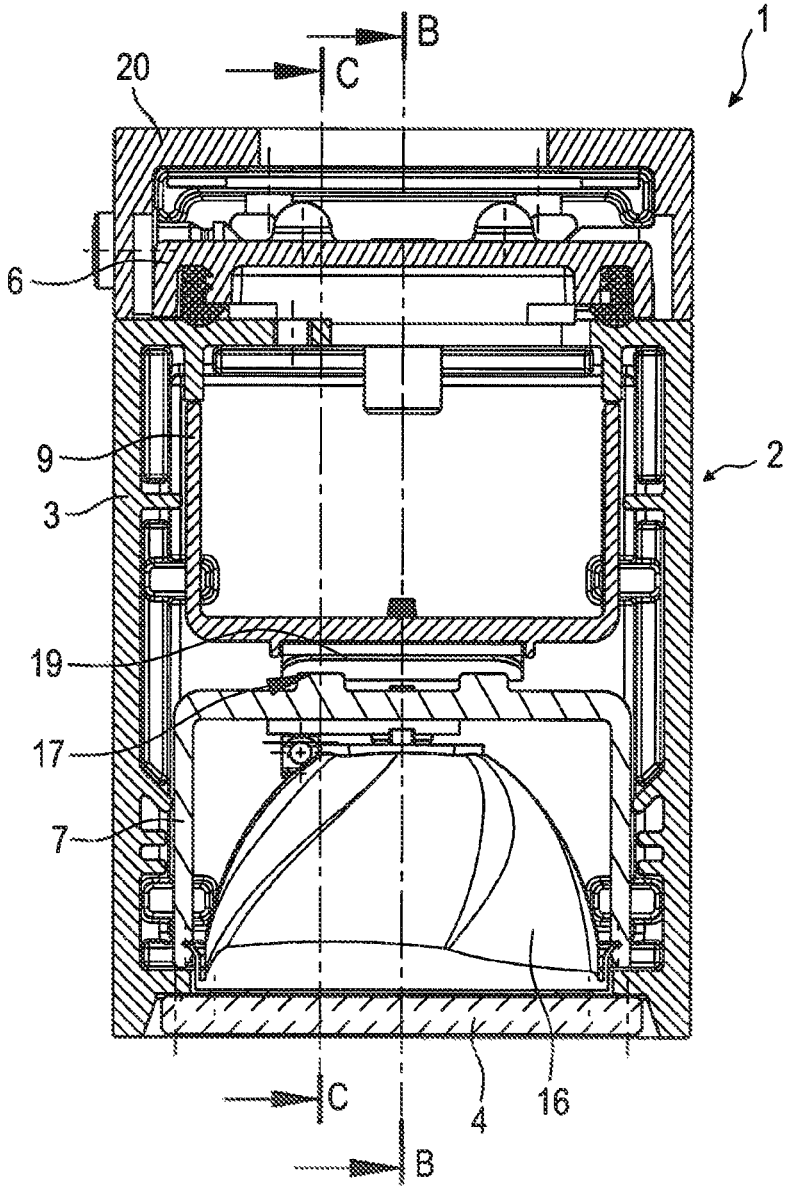
FIG. 2 a cross-section through a linear light according to the invention pursuant to a different embodiment, in particular through a ceiling or wall light.

The embodiment illustrated in FIGS. 2 and 4 corresponds to the embodiments described with reference to FIGS. 1 and 3 with the exception that a lid cap 20, which surrounds the lid 6 in a sealing and/or protective manner, is formed in addition. This way, an additional sealing of the light housing is achieved. This contributes at the same time to the optical compactness of the light housing, in particular because the housing is completely visible in this embodiment as a wall or ceiling light.

With the exception of this lid cap 20, the two embodiments are identical to one another.

During mounting of the linear light according to the invention, the optical profile 7 is at first inserted into the housing 2 through the opening in the outer frame 14. If the optical profile 7 is inserted completely, this component will fall ["fällt"] onto the glass element 4 and into the undercut that is formed by the tapering of the outer frame 14. In this state, the optical profile is fastened and held firmly within the housing 2. The optical profile 7 is now only partially accessible through the opening whereas the other part below the opening is arranged inside the housing.

Subsequently, the electrical profile 9 is inserted into the housing 2 through the opening. Clamping elements installed on the bottom side of the electrical profile 9 create a bracing of the two profiles against the housing out of the translation. The two profiles are fastened within the housing by means of this process. Afterwards, the electrical profile can be secured through screwing. An electrical connection will then be established between the two modules by means of plug-in contacts.

In the displayed embodiment, the clamping force is created by multiple spring elements 19, which are arranged in the area of the electrical profile 9, i.e. on the side of the profile 9 that faces the glass plate 4. During insertion of the electrical profile 9, said electrical profile supports itself, as already explained, on the sliding surface 17 in the area of the optical profile 7 as well as on the inside of the profile 3. When the spring elements come in contact with the optical profile 7, they are compressed by their wedge- or arc-shaped cross-section and consequently create a clamping force. The spring elements 19 can preferably be arranged in the area of the sliding surface.

The linear light according to the invention provides a particularly compact structural form of the light in which the individual components are mounted in a rattle-free way. A particularly sealed light, which can be used without restrictions both in indoor and outdoor areas, can be achieved through the use of seals as well as only small opening areas.

The invention claimed is:

1. A linear light comprising:

an optical element;

an electrical element; and an axially extending housing in which the optical element and the electrical element are integrated, wherein the optical element includes an encasing having a profile that corresponds approximately to a length of the housing, and the electrical element includes an encasing having a profile, the profiles of the encasings of the optical element and the electrical element can be inserted, one at a time, axially into an opening provided at a front axial side of the housing, in an installed state, the profiles of the encasings of the optical element and the electrical element are braced against one another transversally to an axial direction, the housing is closed on all sides, the opening of the housing is smaller than the sum of a cross-section area that is formed by the profiles of the encasings of the optical element and the electrical element in the installed state, spring elements are arranged between the profile of the encasing of the optical element and the profile of the encasing of the electrical element that brace the profiles against one another in the axial direction.

2. The linear light according to claim 1, wherein the front axial side that bears the opening is closed with an intake lid, wherein the opening is disposed in an area of the intake lid that faces away from a light-emitting opening.

3. The linear light according to claim 1, wherein a top side of the profile of the encasing of the optical element is formed with sliding sections that interact with the profile of the encasing of the electrical element.

4. The linear light according to claim 1, wherein the spring element is arranged on the profile of the encasing of the electrical element on a side of the profile of the encasing of the electrical element that is opposite to the profile of the encasing of the optical element.

5. The linear light according to claim 1, wherein rigid clamping elements are disposed between the profile of the encasing of the optical element and the profile of the encasing of the electrical element, and wherein the profile of the encasing of the optical element and the profile of the encasing of the electrical element are elastic in the area of the rigid clamping elements.

6. The linear light according to claim 1, wherein guiding grooves, which interact with the profile of the encasing of the electrical element and the profile of the encasing of the optical element, are arranged on vertical walls of the housing.

7. The linear light according to claim 6, wherein sealing elements are formed in an area of the opening.

8. The linear light according to claim 1, wherein the light is intended for outdoor areas.

9. The linear light according to claim 1, wherein the optical element comprises LED illuminants.

10. The linear light according to claim 1, wherein the housing is made of an aluminum profile and has a rectangular cross-section.

11. The linear light according to claim 1, wherein the front axial side of the housing, which is located opposite to the opening, is equipped with a welded end cap.

12. The linear light according to claim 1, wherein the housing is made of an aluminum profile.

13. The linear light according to claim 1, wherein the housing has a rectangular cross-section.

14. A method for mounting a linear light in an axially extending housing, the method comprising:

inserting an optical element, which includes an encasing having a profile that corresponds approximately to a length of the housing, through an intake opening formed in an area of a front side of the housing, wherein the intake opening is disposed in an upper area of the front side of the housing, fastening the profile of the encasing of the optical element on a light-emitting opening between areas of the front side of the housing that are adjacent to the light-emitting opening, inserting an electrical element, which includes an encasing having a profile, through the intake opening, the intake opening is smaller than the sum of a cross-section area that is formed by the profiles of the encasings of the optical element and the electrical element in an installed state, and as a result, the inserting of the electrical element and the optical element through the intake opening occur one at a time, bracing the profile of the encasing of the optical element and the profile of the encasing of the electrical element against one another in a direction that is transverse to an axial direction of the housing.

15. The method according to claim 14, wherein the optical element is positioned at least in sections under the intake opening between the axial sides on the light-emitting opening after inserting in the housing.

* * * * *